US005828322A

United States Patent [19]

Eberhard

[11] Patent Number: 5,828,322

[45] Date of Patent: Oct. 27, 1998

[54] SYSTEM FOR CONTROLLING DELIVERY AND RETURN OF PRINTED MATTER

[76] Inventor: Hans Joachim Eberhard, Lupinenstrasse 14, D-76287 Rheinstetten, Germany

[21] Appl. No.: 644,662

[22] Filed: Apr. 24, 1996

[30] Foreign Application Priority Data

May 6, 1995 [DE] Germany ..... 195 16 696.5

[51] Int. Cl.[6] ..... G08G 1/123

[52] U.S. Cl. ..... 340/988; 235/384; 340/825.49; 340/539; 364/478.14

[58] Field of Search ..... 340/988, 539, 340/994, 825.34, 825.35, 825.49, 825.54; 701/1; 235/384; 364/468.22, 478.04, 478.14

[56] References Cited

U.S. PATENT DOCUMENTS

| | | | |
|---|---|---|---|
| 5,014,206 | 5/1991 | Scribner et al. | 340/825.49 |
| 5,038,283 | 8/1991 | Caveney | 235/384 |
| 5,220,511 | 6/1993 | Speckhart et al. . | |
| 5,225,990 | 7/1993 | Bunce et al. . | |
| 5,489,898 | 2/1996 | Shigekusa et al. | 340/988 |

*Primary Examiner*—Brent A. Swarthout

*Attorney, Agent, or Firm*—Herbert Dubno; Andrew Wilford

[57] ABSTRACT

Printed matter is distributed between a source location and a plurality of geographically separate target locations by providing at each of the target locations a location transmitter capable of emitting a unique identifying code and packing at the source location individual orders of the printed matter for the target locations into respective containers and providing each of the containers with a container transmitter capable of generating a unique identifying code. The packed containers for a plurality of the target locations are loaded onto a truck and the codes of the containers being loaded are recorded in a respective portable device on each truck along with the respective target locations. The device continuously electronically determines the position of the truck and guides the loaded truck along a route past the respective plurality of target locations in accordance with the electronically determined truck position, typically by providing optical or audible instructions for the driver. When the truck reaches each target location the respective target-location transmitter is read and an acoustic or optical output is generated by the device indicating which of the containers is to be unloaded thereat. Then at each target location any container whose code is associated with the respective target location is unloaded.

20 Claims, 4 Drawing Sheets

SYSTEM FOR CONTROLLING DELIVERY AND RETURN OF PRINTED MATTER

FIELD OF THE INVENTION

The present invention relates to a system for identifying and controlling the delivery and return of printed matter. More particularly this invention concerns the outward distribution of books, periodicals, and the like from the publisher to the wholesaler and from the wholesaler to the retailer and of returns moving oppositely.

BACKGROUND OF THE INVENTION

The distribution of printed matter—books, magazines, newspapers, and various periodicals—between the publisher, wholesalers, and retailers is a particularly complex problem for several reasons. First of all time is frequently a very critical factor in that, for example, a newspaper comes off the press at about midnight and must normally be at the retailer by 5 AM. Furthermore each target location normally has a different mix of printed matter, as a small newsstand in one region might only order a handful of copies of a certain periodical and a great number of another while a similar small newsstand elsewhere will need a different selection. This business is complicated by the fact that the periodicals are frequently sold on consignment or with the understanding that the supplier will take back any unsold copies and give the returner credit for them.

The distribution is further complicated by the fact that it is typically done by truck at night using relatively low-paid workers who cannot be counted on to do more than drop off and pick up packages. The orders are frequently left and the returns are picked up at the target locations in the absence of the operator of the remote locations.

Thus in a typical distribution chain there are the following elements:

- printing up the matter to be distributed,
- packing the printed matter,
- delivering the printed matter from the publisher to the wholesaler,
- unpacking the matter at the wholesaler,
- picking individual orders for the retailers,
- packing the retailers' orders,
- loading the packed orders into trucks,
- delivering the packed orders to the retailers as the truck moves along a prescribed route,
- dropping each packed order off at the appropriate target location (the retailer),
- taking the returns from each retailer at the respective target location, and
- bringing back the returns to the wholesalers and arranging appropriate credits for the retailers.

Obviously this is a complex sequence of events where frequently the following problems are encountered:

- the printed material is delivered too late from the publisher for the wholesaler to incorporate them into the outgoing orders,
- the orders are picked wrong,
- the delivery truck gets lost or skips part of its route, particularly when a replacement or new driver is on,
- tying machines for the order fail or the tied orders come apart,
- the orders get damaged by weather on their way to the retailers,

- the orders are mixed up in the delivery truck and either not delivered or delivered to the wrong vendor,
- the packing tapes or cords fail and the bundles of printed matter come apart,
- the orders are misdelivered because the operator cannot read or determine who is supposed to get them,
- some orders are put on the wrong trucks or left at the source location, and
- returns are lost or credited to the wrong retailer.

Furthermore the delivered materials are often only held in taped bundles so that it is easy for some articles to be stolen before the retailer picks them up. Furthermore, however the printed matter is packed can create an environmental problem. If simple tapes or cords are used, these must be cut and disposed of and if more protective packing is used to prevent damage to the packed goods the disposal problem is even greater.

Another problem lies in identifying which package goes to which target location and which package of returns comes from which target location. The most efficient method known hitherto employs the use of bar codes printed on the packaging. Such bar codes are frequently made unreadable by damage from handling or bad weather. Similar problems are encountered with magnetically coded strips, again from the normally rough handling.

Thus it has been suggested to employ reusable and returnable packages such as boxes of plastic or cardboard, even with fabric walls and slide fasteners. Such reusable packages have not proven satisfactory in that they must meet very disparate requirements, to wit:

- they must be able to hold different sizes of printed matter from large newspapers to small pocket books,
- the contents can be small items to books as heavy as 12 kg,
- it must be easy to fill and empty the reusable container,
- the container must protect its contents from the weather,
- the weight of the empty container must be very small, preferably less than 250 g,
- when empty the container must take up as little space as possible,
- the container must have a long service life,
- the container must protect its contents well,
- the container should not be suitable for other uses to discourage its theft,
- the container should be part of an identifiable pledge system,
- the container must be washable,
- the container should be easily opened to add to it late-arriving printed matter,
- the container must be capable of being used in an automatic transport system,
- the container must be inexpensive,
- the container should be easy to lift and carry, and
- the container should insure maintenance of its contents in original condition.

OBJECTS OF THE INVENTION

It is therefore an object of the present invention to provide an improved distribution system for printed matter.

Another object is the provision of such an improved distribution system for printed matter which overcomes the above-given disadvantages, that is which ensures an accurate and rapid movement of the printed matter from the source location to the target location and opposite movement of the returns.

A further object is to provide an improved container for use in the inventive system.

SUMMARY OF THE INVENTION

Printed matter is distributed between a source location and a plurality of geographically separate target locations according to the invention by providing at each of the target locations a location transmitter capable of emitting a unique identifying code and packing at the source location individual orders of the printed matter for the target locations into respective containers and providing each of the containers with a container transmitter capable of generating a unique identifying code. The packed containers for a plurality of the target locations are loaded onto a truck and the codes of the containers being loaded are recorded in a respective portable device on each truck along with the respective target locations. The device continuously electronically determines the position of the truck and guides the loaded truck along a route past the respective plurality of target locations in accordance with the electronically determined truck position, typically by providing optical or audible instructions for the driver. When the truck reaches each target location the respective target-location transmitter is read and an acoustic or optical output is generated by the device indicating which of the containers is to be unloaded thereat. Then at each target location any container whose code is associated with the respective target location is unloaded.

Thus with this system the device carried in the truck, which can be powered by its own or the truck's battery, in effect keeps an inventory of the containers in the truck and assists the driver not only in dropping off the correct containers, and if necessary picking up any returns, but also in finding his or her way along the route. As a result if the order for a particular target location changes or a location is dropped or added, the system can easily accommodate the change. Even if a fresh driver takes over a route, it is likely that he or she will get all the stops right the first time out. What is more if the driver is not particularly intelligent or organized, the computerized control device will ensure that the deliveries and pickups are made accurately. In fact according to a feature of this invention each control device can have several language modules so that even if the driver does not speak the prevailing language, the device can give instructions in the language he or she understands, as the vocabulary for the street directions and pickup orders is relatively limited.

The position of the truck is determined via the global positioning system which uses signals from several satellites to accurately triangulate any position on the earth. While this system is intentionally made slightly inaccurate to prevent its military use by unauthorized powers, it is possible to effect the desired correction by detecting the target transmitter once the driver is near the desired target location. It is also of course possible to use other systems, such as a compass-based on that keeps track of the direction of movement of the truck along with the distance covered to reckon position, or even an inertial-based or stellar-oriented system.

According to the invention at the source location a battery of the device is charged and information is loaded into the device about the route of the respective truck and the codes of the target locations along the respective route.

The reading/positioning device can communicate at least while at the source location with a host computer for exchange of information. According to the invention this host computer not only loads into the device the target locations of all the stops on the route and the code numbers of all the containers to be delivered, but can also load into the device routing information including a digital map of the route of the respective truck. The device is programmed to issue directional commands, either optically on its display or audibly. On reading any of the codes the device simultaneously records the time when the code is read. This is particularly useful in processing returns.

According to the invention the codes of the container transmitters are read as the respective containers are loaded into the respective truck. This information is merged with the inputted information about target locations to link the container codes with respective target locations. A stationary reader connected to the host computer may be provided at the source location to confirm that the containers are loaded on the right trucks. The code-reading device can ascertain that the containers are loaded in the right order, that is the order they will have to be unloaded in as the truck makes its stops. When the order is incorrect, the device will emit an alarm signal to indicate that a correction should be made.

In a similar vein the device reads the codes of the containers as same are unloaded from the truck and generates an alarm if a container is unloaded from the truck which is not supposed to be unloaded at the target location where the truck is unloading. What is more at each target location an all-done signal is emitted by the device when all of the containers destined for the respective target location have been unloaded from the truck. Another signal can be emitted if the operator attempts to unload a container destined for another location.

In accordance with the invention at the source location a plurality of the containers is supported in a rack during packing of them with the respective orders. The rack comprises a plurality of tracks along which rows of the containers are movable, with some of the containers empty and some full, and the entire rack can subsequently be rolled right into a delivery truck. In another system according to the invention either individual containers or a plurality of angled containers are rolled into a common larger container after passing a packing station. Such a packing station can be provided at both ends of an order-assembling line. Along the conveyor path there can be branches that allow groups of containers to be separated and/or combined so that at the downstream end they are in the desired order.

In order to ensure that late-arriving printed matter can be loaded into the containers each of the containers is oriented adjacent a respective display, and the displays show details of the orders for the respective containers. Thus it is possible right up to the last minute to complete an order. For example all the weekly and monthly periodicals for a newsstand can be loaded into its container(s) early in the day, and at the last minute the daily newspapers are dropped in.

According to another feature of the invention each device holds the codes of containers previously left at each of the target locations along the route of the respective truck. Thus when returns are picked up at each target location in previously issued containers it is possible to read at the source location the codes of picked-up containers and arrange credits for the returned goods for the respective target locations. The truck operator need do nothing more than make the pickup; the more complex work of matching the returns to the customers takes place back at the depot.

According to the invention the transmitters are battery-free transponders. Such devices, when subjected to a radio-frequency field can either oscillate at a predetermined frequency that therefore constitutes the respective code or can actually emit on a standard frequency a predetermined coded signal. Since such a device does not have its own power source and can be made very cheaply, it is virtually maintenance free. The reading/positioning device itself can hold in memory the codes of all the containers in the system to be able to confirm that the containers being dropped off or picked up are correct. Such a device can easily conduct a scan and identify all the transmitters near it, for instance in or near the truck.

The containers according to this invention are flexible and durable bags having closures provided with the respective transmitters. The bags are of triangular outline and have rectangular mouths so that they can easily accommodate large and small printed matter. Each bag can be provided with a simple string closure that is pulled tight to close it. The transmitter can be mounted right on the closure or on a flap of the bag.

According to the invention the bags are held on roller tracks of a rack that is adapted to hold the containers with openings of the container held open for loading the orders into them. Each rack includes a plurality of tracks each adapted to hold a plurality of the containers and provided with means such as rollers for travel of the containers along the tracks. The tracks can be inclined for gravity feed of the containers, or a drive can be provided.

Each target location is provided with a transfer bin provided with the respective target transmitter at each target location. The bin is dimensioned to hold the respective containers. Thus the driver need merely open the bin, take out any containerized returns in it, deposit the new containers, and go to the next stop. The bin can be locked for security.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
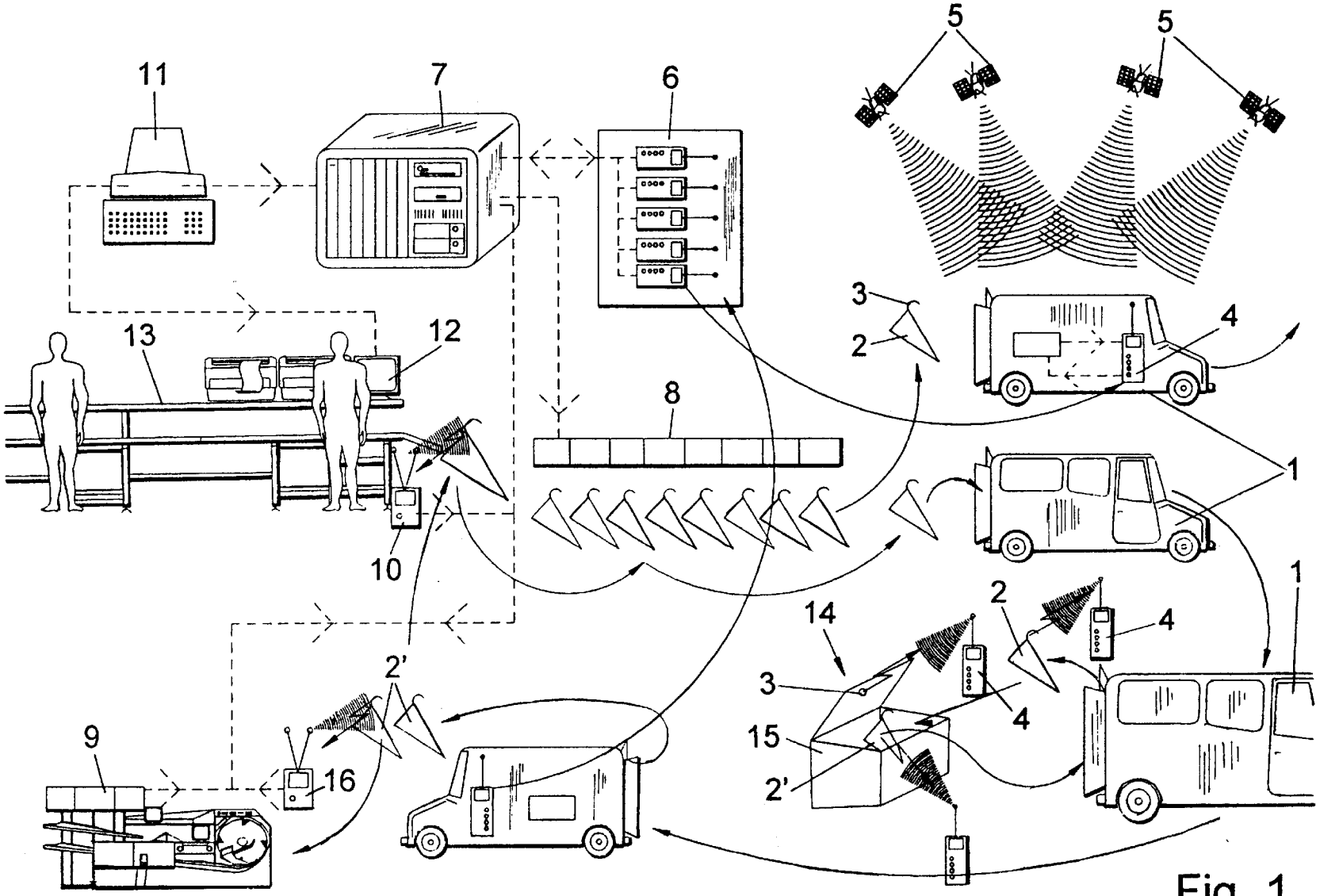
FIG. 1 is a small-scale diagrammatic view illustrating the system of this invention.

As seen in FIG. 1 a delivery vehicle 1, here a van-type truck, is loaded with containers or packages 2, here bags, each provided with a radio-frequency transponder 3. Behind the wind-shield of the truck 1 is a portable reading/locating device 4 capable of reading information from the transponders 3 and of determining the location of the truck 1 from GPS satellites 5. These devices 4 are held at the dispatch location in a charging unit 6 connected to a central computer 7 that is connected for bidirectional communication with these device 4 so it can read information from them and load information into them.

The computer 7 is also connected with a set of displays 8 and also has bidirectional communication with a return station 9 and stationary readers 10 for transponders 3. In addition the computer 7 receives input from a main order-directing or input computer 11 also connected to monitors 12 at the end of an order-processing and -assembly line 13 to display what printed matter goes into which container 2.

The truck 1 delivers the packages 2 to target locations 14 where customers maintain an order box 15 also provided with a transponder 3 detectable by the device 4. The operator of the truck 1 takes the device 4 along when dropping off packages in the bin 15 so that the device 4 can read its transponder 3 also, confirming that the delivery is correct. Packages 2' to be returned are held in the box 15. A reader 16 at the return-processing station 13 reads the code from the transponder 3 of the return bag 2' and reports this information, along with the contents of the bag 2' as determined by the person manning the station 13, to the computer 7 for an appropriate credit.

Figure 2:
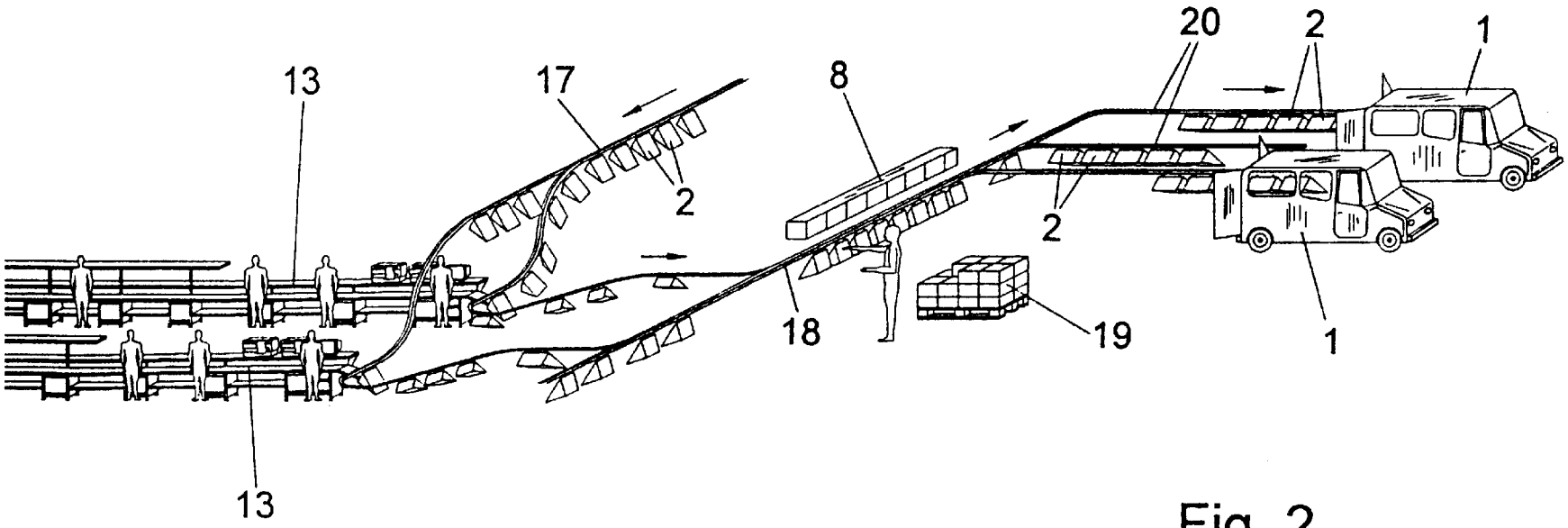
FIGS. 2, 3, and 4 are a small-scale diagrammatic views of details of the inventive system.

FIG. 2 shows the internal business transport of the printed matter at a wholesaler. A retail operation works similarly but other packages are used. In the illustrated embodiments containers 2 come via a roller track 17 to the order-assembling station 13. Printed matter is put into the containers 2 and sent via a roller track 18 to the displays 8. Here late-arriving materials and filler material 19 is loaded into the containers 2. The displays 8 show the coding of the individual containers and show how many copies of which printed materials are to be put in the respective containers 2. Further roller tracks 20 route the filled packages 2 to the appropriate trucks 1.

Figures 3, 4:
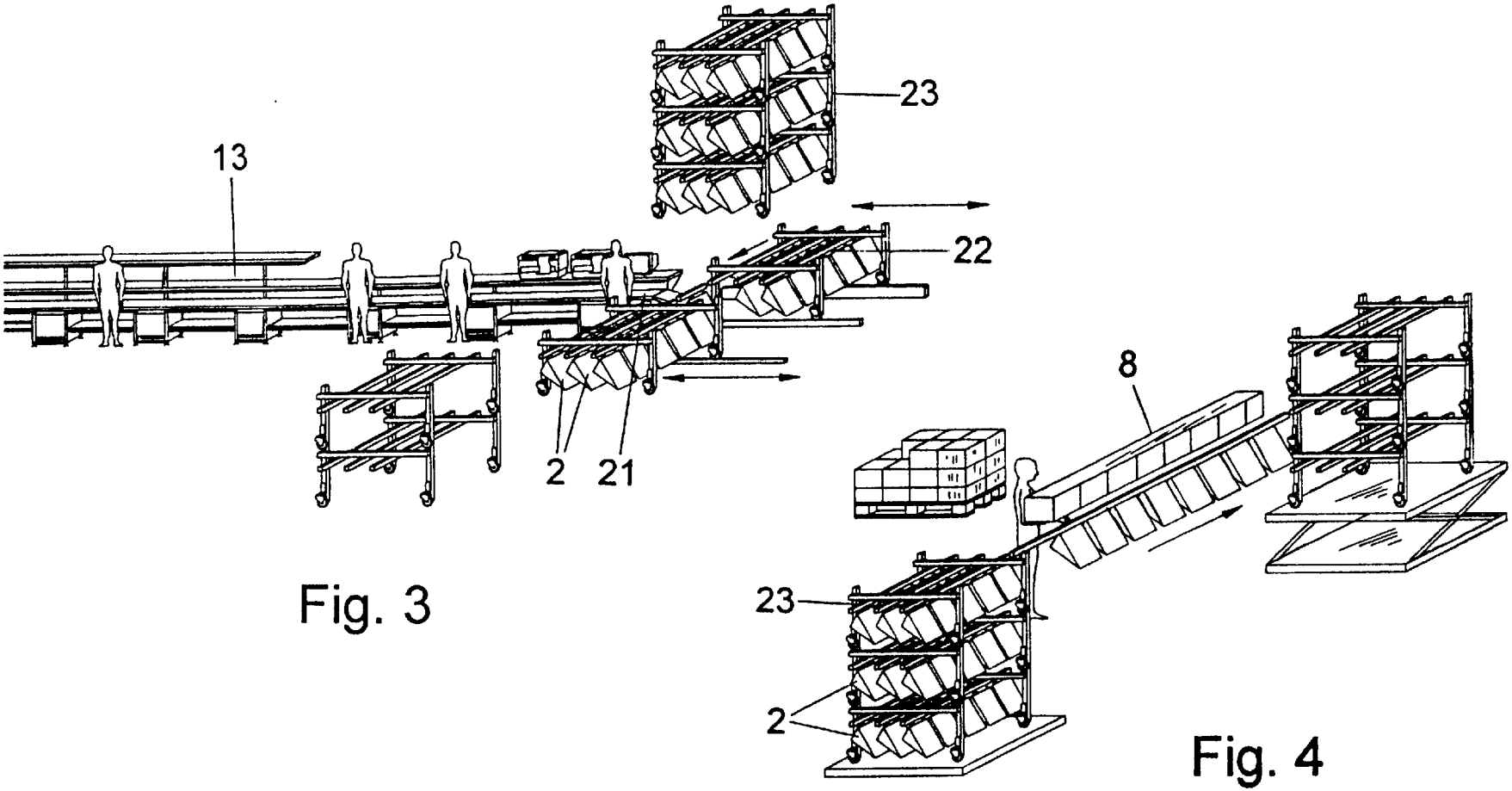

FIGS. 3 and 4 show two regions of another in-plant order-assembly line 13. A filling apparatus is provided at the end of the line 13. The empty containers 2 are hung in short tracks 22 and a plurality of the tracks are hung in a rolling cart 23 one above the other. The tracks 22 may be provided with drives for moving along the respective bags 2. The packages 2 hung on the carts 23 are then moved to the displays 8 as shown in FIG. 4.

Figure 5:
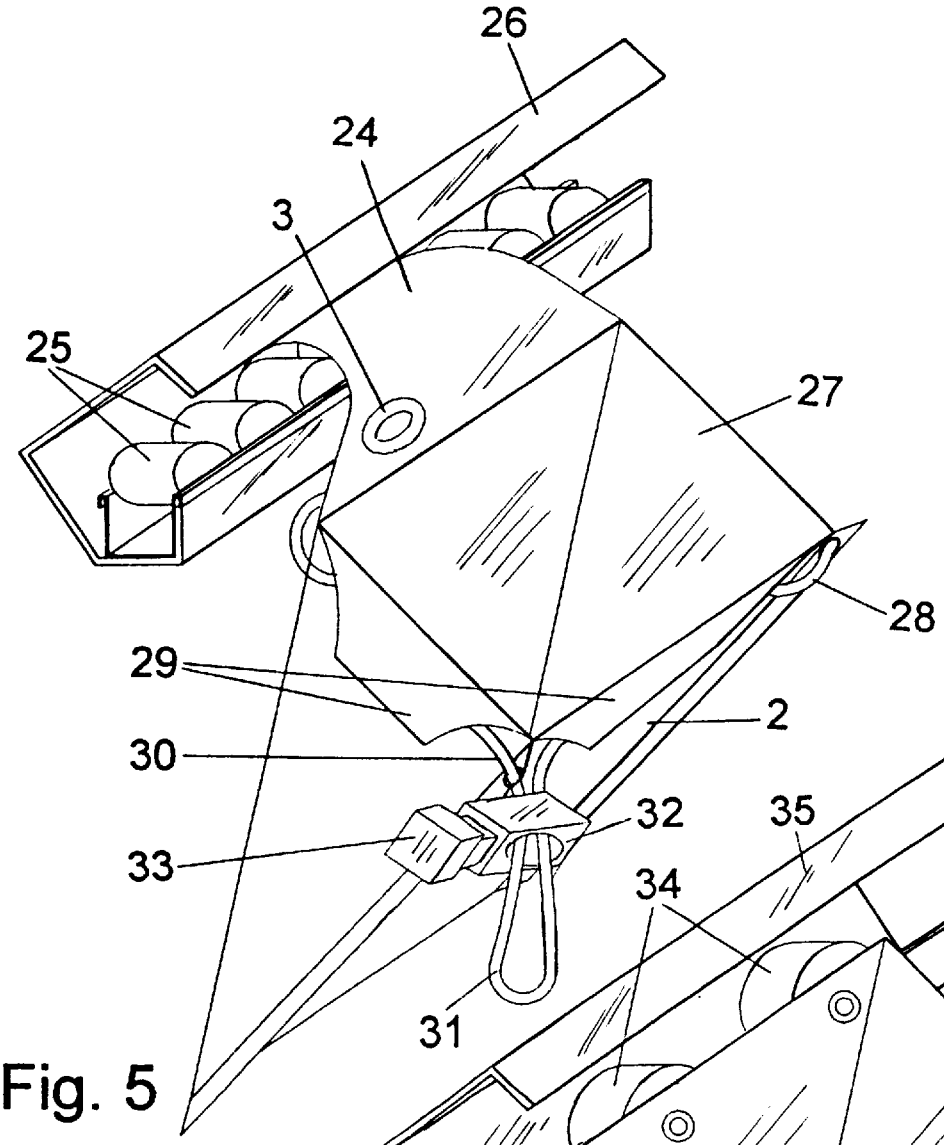
FIG. 5 is a larger-scale perspective view of a packing bag according to the invention.

FIG. 5 shows a container 2 which is a bag having a solid handle 24 engaged on rollers 25 which are provided in a roller track 26. The bag 2 is triangular seen from the side and has a rectangular fill opening or mouth 27 that can accommodate objects as large as tabloid-size magazines. A cord 30 extends through eyes 28 around the edge of the opening 27 or in flaps 29 and has a loop 31 extending through a slide-type cord stop 32 having a button 33 that is depressible to release it. Thus once the bag 2 is full, the cord 30 can be cinched tight to keep the bag's contents from falling out. The transponder 3 is provided on the handle flap 24.

Figure 6:
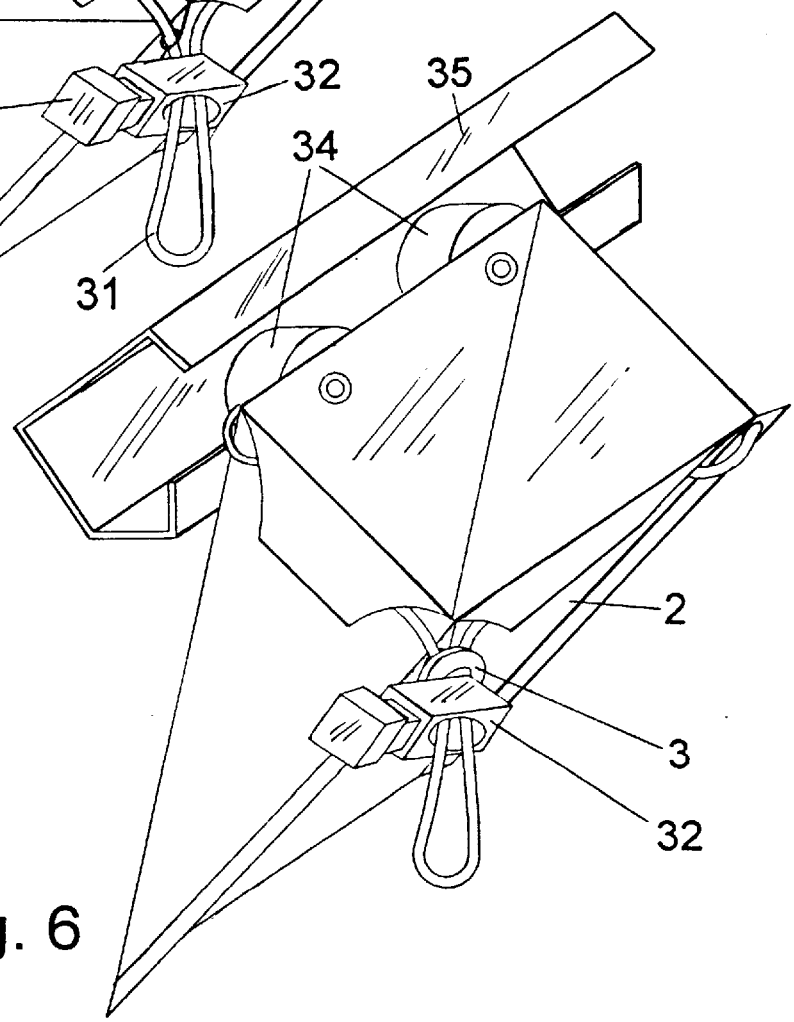
FIG. 6 is a view like FIG. 5 of another packing bag in accordance with this invention.

Alternately as in FIG. 6 the transponder 3 can be provided on the cord 32. Here also this bag 2 carries its own rollers 34 that ride in a track 35.

Thus with this system the orders are assembled on the line 13 by operators who read what is to go into what container 2 from the monitors 12. The partially filled bags are moved to the displays 8 where any late-arriving materials are added, and then the racks 23 are pushed out to the respective trucks 1.

Meanwhile each device 4 is recharged and programmed at 6 for the appropriate route information plus the code numbers of all the containers to go on the respective trucks 1, plus all the code numbers of containers 2 previously dropped off along that route, so that the retailers can be charged if they lose any.

As the containers 2 are loaded into the truck the device 4 for that truck 1, plus another such device which can be mounted at the loading bay, ensures that the proper containers are loaded in the proper order, sounding an alarm if an attempt is made to load a container for another truck or to put the containers in out of order.

The device 4 is normally mounted on the truck's dashboard so the driver can refer to it for directions along his or her route, which directions can be given audibly or optically, even in the driver's own native language if necessary. When the truck 1 is near the appropriate target location 14 the device 4 warns the driver.

Once stopped the device 4 reads the transmitter 3 of the bin 15 to confirm that the proper destination is reached, and to correct any inaccuracies in the GPS positioning. The codes of any bags 2 taken from the bin 15 are read, as are the codes of the bags 2 loaded into it. If the driver attempts to unload a bag 2 for another destination, the device 4 emits a warning, and if the driver attempts to leave without dropping off all the bags 2 for a given destination another alarm is given.

Once back at the source location the returns are simply unloaded to the return-processing station 9 and the device 4 downloads to the central computer 7 the numbers and locations of any pickups, and the returns are properly credited. Thus this system allows even a person with no real understanding of what is happening to make a series of deliveries and pickups with great accuracy.

I claim:

1. A method of distributing printed matter between a source location and a plurality of geographically separate target locations, the method comprising the steps of:

a) providing at each of the target locations a location transmitter capable of emitting a unique identifying code;

b) packing at the source location individual orders of the printed matter for the target locations into respective containers and providing each of the containers with a container transmitter capable of generating a unique identifying code;

c) loading the packed containers for a plurality of the target locations onto a truck;

d) recording in a respective portable device on each truck the codes of the container transmitters loaded into the truck as well as the respective target locations;

e) continuously electronically determining the position of the truck and guiding the loaded truck along a route past the respective plurality of target locations in accordance with the electronically determined truck position;

f) when the truck reaches each target location reading the respective target-location transmitter and generating an acoustic or optical output indicating which of the containers is to be unloaded thereat; and g) at each target location unloading any container whose code is associated with the respective target location.

2. The printed-matter distribution method defined in claim 1 wherein the position of the truck is determined via the global positioning system.

3. The printed-matter distribution method defined in claim 2 wherein at each target location the electronically determined location is corrected by reading the code of the respective target location, comparing its known location with the electronically determined location, and eliminating any difference.

4. The printed-matter distribution method defined in claim 1, further comprising the step prior to step d) of d') charging a battery of the device; and d") loading into the device information about the route of the respective truck and the codes of the target locations along the respective route.

5. The printed-matter distribution method defined in claim 4, further comprising the step prior to step d) of d'") loading in to the device routing information including a digital map of the route of the respective truck.

6. The printed-matter distribution method defined in claim 1, further comprising the step on reading any of the codes of simultaneously recording the time when the code is read.

7. The printed-matter distribution method defined in claim 1, further comprising the step of reading the codes of the container transmitters as the respective containers are loaded into the respective truck.

8. The printed-matter distribution method defined in claim 1 further comprising the step of reading with the device the codes of the containers as same are unloaded in step g) from the truck and generating with the device an alarm if a container is unloaded from the truck which is not supposed to be unloaded at the target location where the truck is unloading.

9. The printed-matter distribution method defined in claim 8, further comprising the step of generating at each target location an all-done signal when all of the containers destined for the respective target location have been unloaded from the truck.

10. The printed-matter distribution method defined in claim 1, further comprising the step of supporting a plurality of the containers in a rack during packing of them with the respective orders.

11. The printed-matter distribution method defined in claim 10, further comprising the steps of:

orienting each of the containers adjacent a respective display; and displaying on the displays details of the orders for the respective containers.

12. The printed-matter distribution method defined in claim 1, further comprising the steps of:

recording in each device the codes of containers previously left at each of the target locations along the route of the respective truck; and picking up returns at each target location in previously issued containers; and reading at the source location the codes of picked-up containers and arranging credits for the returned goods for the respective target locations.

13. A system for distributing printed matter between a source location and a plurality of geographically separate target locations, the system comprising:

a location transmitter capable of emitting a unique identifying code at each of the target locations;

respective containers each adapted to hold a respective individual order of the printed matter for a respective one of the target locations;

a container transmitter on each container capable of generating a unique identifying code;

a truck adapted to travel along a respective route past a respective plurality of the target locations and adapted to hold a plurality of the order-holding containers for the respective target locations;

a respective portable device on each truck in which is recorded the codes of the container transmitters loaded into the truck as well as the respective target locations;

means for continuously electronically determining the position of the truck and guiding the loaded truck along a route past the respective plurality of target locations in accordance with the electronically determined truck position;

means in the device for, when the truck reaches each target location, reading the respective target-location transmitter and generating an acoustic or optical output indicating which of the containers is to be unloaded thereat.

14. The system defined in claim 13 wherein the transmitters are battery-free transponders.

15. The system defined in claim 13 wherein the containers have closures provided with the respective transmitters.

16. The system defined in claim 13 wherein the containers are flexible bags.

17. The system defined in claim 16 wherein the bags are of triangular outline and have rectangular mouths.

18. The system defined in claim 13, further comprising means for loading the orders into the respective containers, the means including a rack adapted to hold the containers with openings of the container held open.

19. The system defined in claim 18 wherein the rack includes a plurality of tracks each adapted to hold a plurality of the containers and provided with means for travel of the containers along the tracks.

20. The system defined in claim 13, further comprising a transfer bin provided with the respective target transmitter at each target location, the bin being dimensioned to hold the respective containers.

* * * * *